US008898981B2

(12) United States Patent
Egan et al.

(10) Patent No.: US 8,898,981 B2
(45) **Date of Patent: *Dec. 2, 2014**

(54) EXTERIOR FINISH SYSTEM

(71) Applicant: Construction Research & Technology GmbH, Trostberg (DE)

(72) Inventors: William F. Egan, Ponte Vedra Beach, FL (US); Eric S. Auman, Jacksonville, FL (US); Steffen Wache, Breitbrunn (DE); Kevin Brands, Plymouth, MN (US); Lea Cruz, Shakopee, MN (US); Sandra R. Sprouts, Oakwood Village, OH (US)

(73) Assignee: Construction Research & Technology GmbH, Trostberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/297,089

(22) Filed: Jun. 5, 2014

(65) Prior Publication Data

US 2014/0311069 A1 Oct. 23, 2014

Related U.S. Application Data

(63) Continuation of application No. 13/027,869, filed on Feb. 15, 2011, now Pat. No. 8,806,825.

(60) Provisional application No. 61/304,611, filed on Feb. 15, 2010.

(51) Int. Cl.

| | |
|---|---|
| ***E04B 1/64*** | (2006.01) |
| ***E04B 1/66*** | (2006.01) |
| ***E04C 2/20*** | (2006.01) |
| ***E04B 1/62*** | (2006.01) |

(52) U.S. Cl.

CPC ... *E04B 1/62* (2013.01); *E04B 1/64* (2013.01); *E04B 1/66* (2013.01)

USPC ..... 52/411; 52/302.1; 52/309.3; 52/408; 52/515; 428/317.5

(58) Field of Classification Search

USPC ..... 52/408, 506.01, 515, 741.3, 302.1, 52/309.1, 309.3, 309.13, 411, 630; 428/304.4, 317.1, 317.5

See application file for complete search history.

(56) References Cited

U.S. PATENT DOCUMENTS

| | | | |
|---|---|---|---|
| 3,493,529 | A | 2/1970 | Ellers et al. |
| 3,687,759 | A | 8/1972 | Werner et al. |

(Continued)

FOREIGN PATENT DOCUMENTS

| | | | |
|---|---|---|---|
| WO | WO 2011100751 | A2 * | 8/2011 |
| WO | WO 2011100751 | A3 * | 6/2012 |
| WO | WO 2013087391 | A1 | 6/2013 |

OTHER PUBLICATIONS

PCT/US2011/024915—International Preliminary Report on Patentability, mailed Aug. 21, 2012.

(Continued)

*Primary Examiner* — Basil Katcheves
*Assistant Examiner* — Rodney Mintz
(74) *Attorney, Agent, or Firm* — Curatolo Sidoti Co., LPA; Salvatore A. Sidoti; Daniel E. Moderick, Jr.

(57) ABSTRACT

Disclosed is an exterior finish system for building structures that includes a water pervious adhesive for securing an insulation layer to a water resistive barrier applied to a building wall substrate. Also disclosed is a building structure such as a building column or wall that includes the finish system and a method of using the finish system to assemble a building structure such as a column or wall.

20 Claims, 1 Drawing Sheet

(56) References Cited

U.S. PATENT DOCUMENTS

| | | | | |
|---|---|---|---|---|
| 3,691,004 | A | 9/1972 | Werner et al. | |
| 4,212,692 | A | 7/1980 | Rasen et al. | |
| 4,272,936 | A | 6/1981 | Bonaguidi | |
| 4,339,273 | A | 7/1982 | Meier et al. | |
| 4,339,405 | A | 7/1982 | Paszner | |
| 4,425,746 | A | 1/1984 | Bonaguidi | |
| 4,515,839 | A | 5/1985 | Broaddus et al. | |
| 4,778,529 | A | 10/1988 | Barker et al. | |
| 4,882,888 | A * | 11/1989 | Moore | 52/309.9 |
| 5,410,852 | A | 5/1995 | Edgar et al. | |
| 5,678,326 | A | 10/1997 | Pavelescu | |
| 5,814,146 | A | 9/1998 | Maggio et al. | |
| 5,979,131 | A | 11/1999 | Remmele et al. | |
| 6,079,175 | A | 6/2000 | Clear | |
| 6,084,011 | A | 7/2000 | Lucero et al. | |
| 6,131,353 | A | 10/2000 | Egan | |
| 6,172,147 | B1 | 1/2001 | Abelleira et al. | |
| 6,223,414 | B1 | 5/2001 | Hodek et al. | |
| 6,355,333 | B1 | 3/2002 | Waggoner et al. | |
| 6,395,401 | B1 | 5/2002 | Bramlett et al. | |
| 6,410,118 | B1 | 6/2002 | Reicherts et al. | |
| 6,442,912 | B1 | 9/2002 | Phillips et al. | |
| 6,536,176 | B1 | 3/2003 | Nordgren et al. | |
| 6,616,752 | B1 | 9/2003 | Basura et al. | |
| 6,692,595 | B2 | 2/2004 | Wheatley et al. | |
| 6,695,909 | B1 | 2/2004 | Zhu | |
| 6,745,531 | B1 | 6/2004 | Egan | |
| 6,745,535 | B2 | 6/2004 | Nordgren et al. | |
| 6,759,135 | B2 | 7/2004 | Bramlett et al. | |
| 6,790,544 | B2 | 9/2004 | Schmitz | |
| 6,804,922 | B1 | 10/2004 | Egan | |
| 6,807,786 | B1 | 10/2004 | Peck | |
| 6,931,809 | B1 | 8/2005 | Brown et al. | |
| 7,049,251 | B2 | 5/2006 | Porter | |
| 7,082,733 | B2 | 8/2006 | Nordgren et al. | |
| 7,148,160 | B2 | 12/2006 | Porter | |
| 7,166,365 | B2 | 1/2007 | Bramlett et al. | |
| 7,196,024 | B2 | 3/2007 | Lubker, II | |
| 7,204,065 | B2 | 4/2007 | Naji | |
| RE39,839 | E | 9/2007 | Wheatley et al. | |
| 7,300,515 | B2 | 11/2007 | Porter | |
| 7,300,892 | B2 | 11/2007 | Porter | |
| 7,608,328 | B2 | 10/2009 | Eevers et al. | |
| 7,625,827 | B2 | 12/2009 | Egan et al. | |
| 7,658,040 | B2 | 2/2010 | Bennett et al. | |
| 7,662,221 | B2 | 2/2010 | Fay | |
| 7,815,728 | B2 | 10/2010 | Stratton et al. | |
| 7,902,092 | B2 | 3/2011 | Egan et al. | |
| 7,984,594 | B1 | 7/2011 | Propst | |
| 8,007,584 | B2 | 8/2011 | Garuti et al. | |
| 8,038,789 | B2 | 10/2011 | Boxley | |
| 8,051,611 | B2 | 11/2011 | Serino et al. | |
| 8,067,059 | B2 | 11/2011 | Birger | |
| 8,157,910 | B2 | 4/2012 | Stratton et al. | |
| 8,215,083 | B2 | 7/2012 | Toas et al. | |
| 8,245,472 | B2 | 8/2012 | Keene | |
| 8,298,967 | B2 | 10/2012 | Egan et al. | |
| 8,312,690 | B1 | 11/2012 | Klemaske et al. | |
| 8,366,824 | B2 | 2/2013 | Stratton et al. | |
| 8,367,183 | B2 | 2/2013 | Take et al. | |
| 8,394,191 | B2 | 3/2013 | Bury | |
| 8,413,333 | B2 | 4/2013 | Dinkel | |
| 8,524,359 | B2 | 9/2013 | Tsunemori et al. | |
| 8,529,693 | B2 | 9/2013 | Kratschmer et al. | |
| 8,592,040 | B2 * | 11/2013 | Hayes et al. | 428/432 |
| 8,640,421 | B2 | 2/2014 | Frobosilo | |
| 8,789,329 | B2 * | 7/2014 | Radoane | 52/309.5 |
| 8,806,825 | B2 * | 8/2014 | Egan et al. | 52/411 |
| 2001/0055928 | A1 | 12/2001 | Eevers et al. | |
| 2002/0090871 | A1 | 7/2002 | Ritchie et al. | |
| 2002/0148181 | A1 | 10/2002 | Friesner | |
| 2002/0152711 | A1 | 10/2002 | Schmitz | |
| 2002/0170648 | A1 | 11/2002 | Dinkel | |
| 2002/0182963 | A1 | 12/2002 | Bramlett et al. | |
| 2003/0003270 | A1 | 1/2003 | Wheatley et al. | |
| 2003/0223819 | A1 | 12/2003 | Ianniello et al. | |
| 2004/0067352 | A1 | 4/2004 | Hagerman et al. | |
| 2004/0096645 | A1 | 5/2004 | Hancy et al. | |
| 2004/0142618 | A1 | 7/2004 | Porter | |
| 2004/0157055 | A1 | 8/2004 | Bramlett et al. | |
| 2005/0144901 | A1 | 7/2005 | Egan et al. | |
| 2005/0229524 | A1 | 10/2005 | Bennett et al. | |
| 2006/0019568 | A1 | 1/2006 | Toas et al. | |
| 2006/0065342 | A1 | 3/2006 | Porter | |
| 2006/0101758 | A1 | 5/2006 | Egan | |
| 2006/0105653 | A1 | 5/2006 | Porter | |
| 2006/0257643 | A1 | 11/2006 | Birger | |
| 2006/0277837 | A1 | 12/2006 | Wilsey | |
| 2006/0277854 | A1 | 12/2006 | Egan | |
| 2007/0084139 | A1 | 4/2007 | Stender | |
| 2007/0094964 | A1 | 5/2007 | Stender | |
| 2007/0110955 | A1 | 5/2007 | Eevers et al. | |
| 2007/0294976 | A1 | 12/2007 | Fay | |
| 2008/0120932 | A1 | 5/2008 | Paradis | |
| 2008/0156225 | A1 | 7/2008 | Bury | |
| 2009/0038249 | A1 | 2/2009 | Coulton et al. | |
| 2009/0239430 | A1 | 9/2009 | Egan et al. | |
| 2009/0266025 | A1 | 10/2009 | Toas et al. | |
| 2009/0282762 | A1 | 11/2009 | Iske et al. | |
| 2010/0034978 | A1 | 2/2010 | Garuti et al. | |
| 2010/0058957 | A1 | 3/2010 | Boxley | |
| 2010/0095607 | A1 | 4/2010 | Bennett et al. | |
| 2010/0112329 | A1 | 5/2010 | Yi | |
| 2010/0132294 | A1 | 6/2010 | Bennett et al. | |
| 2010/0146788 | A1 | 6/2010 | Dinkel | |
| 2010/0212552 | A1 | 8/2010 | Stratton et al. | |
| 2010/0285224 | A1 | 11/2010 | Fisher | |
| 2011/0036035 | A1 | 2/2011 | Dettbarn et al. | |
| 2011/0038668 | A1 | 2/2011 | Exline et al. | |
| 2011/0064517 | A1 | 3/2011 | Sader | |
| 2011/0078971 | A1 | 4/2011 | Adams | |
| 2011/0091367 | A1 | 4/2011 | Sergi et al. | |
| 2011/0135879 | A1 | 6/2011 | Bennett et al. | |
| 2011/0143616 | A1 | 6/2011 | Egan et al. | |
| 2011/0154764 | A1 | 6/2011 | Wang et al. | |
| 2011/0178209 | A1 * | 7/2011 | Ganpule | 524/5 |
| 2011/0197528 | A1 * | 8/2011 | Egan et al. | 52/302.1 |
| 2011/0256786 | A1 | 10/2011 | Bomberg | |
| 2011/0258944 | A1 | 10/2011 | Radoane | |
| 2011/0283917 | A1 | 11/2011 | Garuti et al. | |
| 2012/0073228 | A1 * | 3/2012 | Fork et al. | 52/309.13 |
| 2012/0124931 | A1 | 5/2012 | Carbary et al. | |
| 2012/0148826 | A1 | 6/2012 | Kratschmer et al. | |
| 2012/0298291 | A1 | 11/2012 | Smith | |
| 2012/0317914 | A1 | 12/2012 | Bomberg et al. | |
| 2013/0042557 | A1 | 2/2013 | Egan et al. | |
| 2013/0139729 | A1 | 6/2013 | Ong et al. | |
| 2013/0231019 | A1 | 9/2013 | Dinkel | |
| 2013/0267637 | A1 | 10/2013 | Varkey et al. | |
| 2013/0283715 | A1 | 10/2013 | Bennett et al. | |
| 2013/0303690 | A1 | 11/2013 | Varkey et al. | |
| 2014/0096460 | A1 | 4/2014 | Toorell et al. | |
| 2014/0115989 | A1 | 5/2014 | Sievers et al. | |
| 2014/0196396 | A1 * | 7/2014 | Watts et al. | 52/408 |
| 2014/0216304 | A1 * | 8/2014 | Hou et al. | 106/708 |

OTHER PUBLICATIONS

PCT/US2011/024915—International Search Report, mailed May 15, 2012.

PCT/US2011/024915—International Written Opinion, mailed May 15, 2012.

* cited by examiner

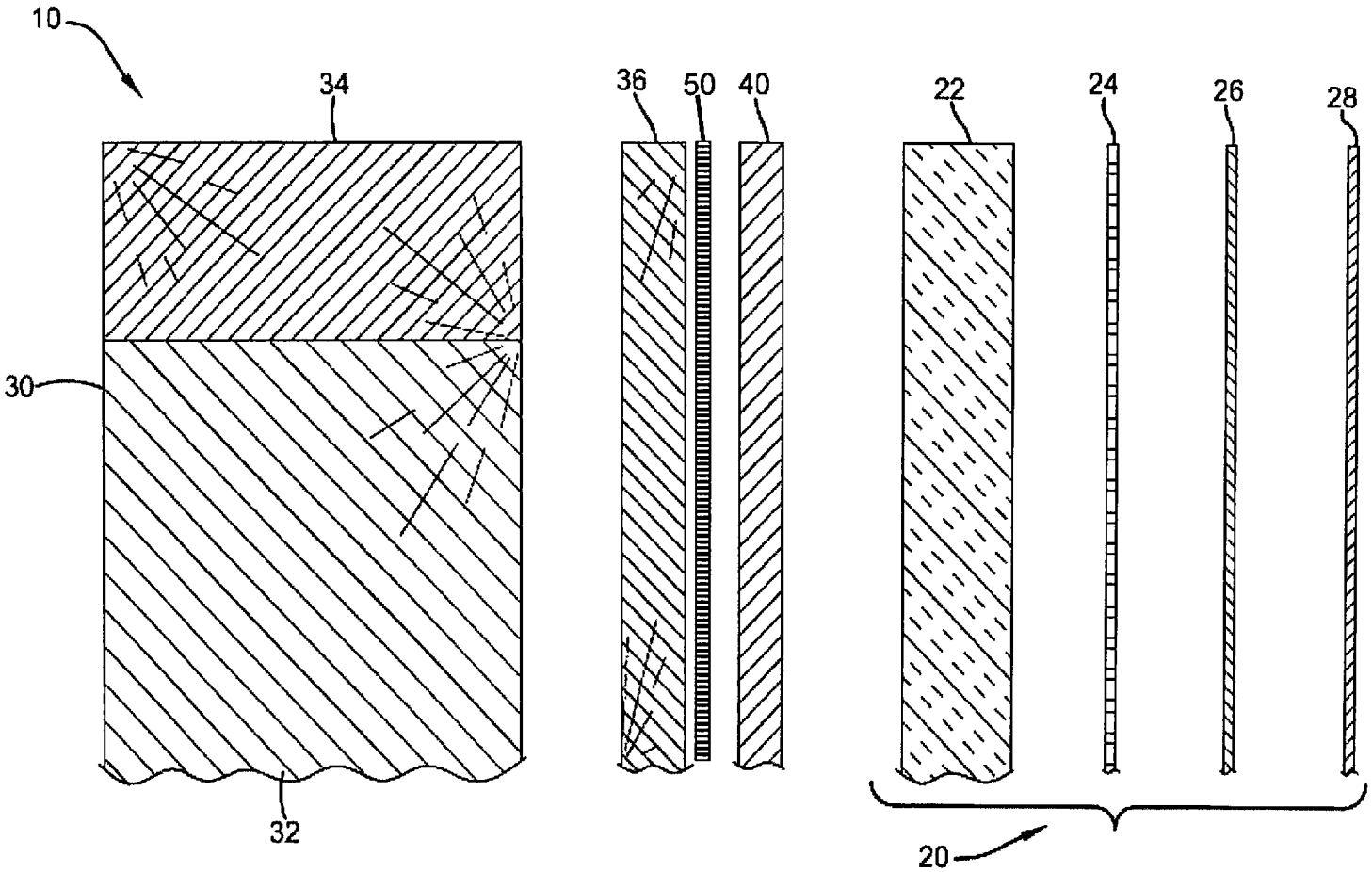
28
26
24
22
20
40
50
36
34
32
10
30

EXTERIOR FINISH SYSTEM

CROSS REFERENCE TO RELATED APPLICATIONS

This application is a continuation of U.S. Ser. No. 13/027,869, filed Feb. 15, 2011, which claims the benefit of the filing date under 35 U.S.C. 111(b) from U.S. Provisional Application Patent Ser. No. 61/304,611, filed Feb. 15, 2010, both of which are hereby incorporated by reference.

TECHNICAL FIELD

A finish system for application to surfaces of building structure is disclosed. Also disclosed is a building structure incorporating the finish system and method of using the finish system to assemble a building structure. The finish system includes a water pervious adhesive layer that is used to secure certain components of the finish system to a building wall substrate or to a water resistive barrier that has been applied to a building substrate.

BACKGROUND

Modern techniques for constructing the walls of buildings may take numerous forms. Among these is the two-by-four (2×4) framed construction. Conventional 2×4 wall construction begins with framing of the walls with wood or metal (such as, steel) members. These wood or steel members typically have nominal dimensions of 2"×4" and are, therefore, called "two-by-four" or 2×4. These 2×4s are oriented vertically and spaced at intervals generally either 16" or 24" and are each connected at the top and bottom to similar members that are horizontally oriented. This structure is referred to in the relevant art as a "framed" wall. A sheet of building wall substrate, such as plywood sheathing or other material, is then applied to the exterior of the framed wall.

A water-resistive barrier is then typically applied to the exterior of the sheathing, with an external wall cladding or finish then being applied directly over the water-resistive barrier. Many materials may be used for the external wall finish such as brick, stucco, Exterior Insulation and Finish System (EIFS), vinyl or aluminum siding, wood, etc. A sheet of gypsum board or drywall is typically applied to the interior facing surface of the framed wall toward the living area.

Exterior Insulation and Finish Systems (EIFS) are commonly used as an exterior wall cladding or finish on both commercial and residential buildings. EIFS are comprised of a rigid insulation board typically of expanded polystyrene (EPS) that is positioned directly over the exterior surface of a building wall substrate or over the exterior surface of the water resistive barrier which has been previously applied over a building wall substrate. A base coat layer is applied to the EPS insulation board. A reinforcing fiberglass mesh is substantially embedded in the base coat. A decorative and protective finish coat is applied over of the base coat and reinforcing fiberglass mesh.

During the installation of EIFS, an adhesive is applied to the back side of the rigid insulation board to adhere the insulation board to the water barrier which has been previously applied to the building wall sheathing. The adhesive material is often applied in a vertical ribbon pattern using a trowel having spaced apart notches. The insulation board is then brought into contact with the building wall sheathing such that the vertical ribbons of adhesive create channels that provide a drainage path to direct incidental moisture, if any, to the building exterior as well as attach the EIFS insulation board to the building wall sheathing. The remaining EIFS components (base coat, reinforcing mesh, finish coat) are applied in subsequent layers.

The effectiveness of EIFS to direct and drain incidental moisture can be impacted by the means used to install the adhesive and/or insulation. For example, if the vertical ribbons of adhesive are not applied properly or if the insulation board is not placed properly, the channels may not be capable of directing and draining moisture as intended.

If incidental water or moisture should penetrate the building envelope, the water barrier mentioned above serves as an additional obstacle to the intrusion of such water or other elements onto the sheathing material and into the wall. The water barrier also provides a surface to collect the moisture and direct it to the exterior of the building. If water is permitted to flow through the water resistive barrier and onto the sheathing material, the water may remain trapped in the sheathing material, which may result in deterioration of the sheathing material and underlying building components, thus requiring repair or replacement.

Moreover, moisture from the environment may become trapped between the external wall covering and the weather barrier. In the latter circumstance, if the weather barrier contains significant voids, cuts, gaps, etc., whether incurred during construction or due to settling of the structure, any such moisture may find its way through the opening in the weather barrier, onto the sheathing material, and eventually into the wall with the deleterious effects described above. Furthermore, such trapped moisture can reduce the wall system components' serviceability and service life.

SUMMARY

Disclosed is an exterior finish system for building walls comprising an insulation layer having opposite facing surfaces; a water pervious adhesive adjacent one of said opposite facing surfaces of said insulation layer; and an exterior finish material applied to the opposite facing surface of said insulation layer.

Additionally disclosed is a building wall comprising a building wall substrate; a water resistive barrier layer applied to said building wall substrate; an insulation layer having opposite facing surfaces; a water pervious adhesive layer disposed between said water resistive barrier layer and said insulation layer to adhere the insulation layer to the water resistive barrier layer; an exterior finish material applied to the exteriorly facing surface said insulation layer.

Further disclosed is a method of finishing a building structure comprising: applying a water pervious adhesive between a surface of one of a building wall substrate or a water-resistive barrier and an insulation layer; adhering said insulation layer to said building wall substate with said adhesive disposed therebetween; and applying an exterior finish material to the exteriorly facing surface of said insulation layer.

BRIEF DESCRIPTION OF THE DRAWING

FIG. 1 is an exploded side view of an illustrative embodiment of the building wall.

DETAILED DESCRIPTION

Provided is an exterior finish system for use in building structures. The exterior finish system includes an insulation layer having opposite facing major surfaces. A liquid water pervious adhesive material is disposed adjacent one of the opposite facing major surfaces of the insulation layer for adhering the insulation layer to the exteriorly facing surface of a building wall substrate. A decorative and protective exterior finish material is applied to the surface of the insulation layer that is opposite to the surface of the insulation layer that is adjacent the liquid water pervious adhesive. The use of the liquid water pervious adhesive layer provides a means to drain incidental water that has entered the exterior finish system or building wall.

According to certain illustrative embodiments, the exterior finish system includes an insulation layer having opposite facing major surfaces. A liquid water pervious adhesive material is disposed adjacent one of the opposite facing major surfaces of the insulation layer for adhering the insulation layer to the exteriorly facing surface of a building wall substrate. An exterior insulation and finish system base coat is applied to the surface of the insulation layer that is opposite to the surface of the insulation layer that is adjacent the liquid water pervious adhesive. A reinforcing mesh is at least partially embedded within the base coat. An exterior insulation and finish system finish coat layer is applied over the base coat and reinforcing mesh.

According to certain illustrative embodiments, the exterior finish system includes an insulation layer having opposite facing major surfaces. A liquid water pervious adhesive material is disposed adjacent one of the opposite facing major surfaces of the insulation layer for adhering the insulation layer to the exteriorly facing surface of a building wall substrate. A stucco lath is applied to the surface of the insulation layer that is opposite to the surface of the insulation layer that is adjacent the liquid water pervious adhesive. At least one stucco layer is applied to the stucco lath.

A building wall including the exterior finish system is also provided. The building wall includes a building wall substrate. A water resistive barrier is applied to the exteriorly facing surface of the building wall substrate. An insulation layer having opposite facing major surfaces is adhered to the water resistive barrier with a liquid water pervious adhesive. The liquid water pervious adhesive for adhering the insulation layer to the building wall substrate is disposed between the exteriorly facing surface of a water resistive barrier coated building wall substrate and the interiorly facing surface of the insulation layer. A decorative and protective exterior finish comprising one or more layers of exterior finish materials is applied to the surface of the insulation layer that is opposite to the surface of the insulation layer that is adjacent the liquid water pervious adhesive.

According to certain illustrative embodiments, the building wall includes a building wall substrate. A water resistive barrier is applied to the exteriorly facing surface of the building wall substrate. The building wall includes an insulation layer having opposite facing major surfaces. A liquid water pervious adhesive material is disposed adjacent one of the opposite facing major surfaces of the insulation layer for adhering the insulation layer to the exteriorly facing surface of a building wall substrate. An exterior insulation and finish system base coat is applied to the surface of the insulation layer that is opposite to the surface of the insulation layer that is adjacent the liquid water pervious adhesive. A reinforcing mesh is at least partially embedded within the base coat. An exterior insulation and finish system finish coat layer is applied over the base coat and reinforcing mesh.

According to certain illustrative embodiments, the building wall includes a building wall substrate. A water resistive barrier is applied to the exteriorly facing surface of the building wall substrate. The building wall includes an insulation layer having opposite facing major surfaces. A liquid water pervious adhesive material is disposed adjacent one of the opposite facing major surfaces of the insulation layer for adhering the insulation layer to the exteriorly facing surface of a building wall substrate. A stucco lath is applied to the surface of the insulation layer that is opposite to the surface of the insulation layer that is adjacent the liquid water pervious adhesive. At least one stucco layer is applied to the stucco lath.

The building wall substrate may include any building wall substate known and used in the building and construction industry. Without limitation, the building wall substrate may be selected from a framed wall (including wood framed and metal framed walls), plywood sheathing, cement board, gypsum board, oriented strand board, wafer board, fiberboard, poured concrete wall, concrete masonry units, metal lath, and non-metal lath.

The insulation layer that is used in the exterior finish system and building wall generally comprises a polymeric material having a building code accepted insulating value. According to certain illustrative embodiments, the polymer insulation layer comprises a polymeric insulation board. The polymeric insulation board may comprise a substantially rigid expanded polystyrene board. Without limitation, and only by way of illustration, a suitable polystyrene insulation board is commercially available from Falcon Foam, A Division of Atlas Roofing Corporation (Byron Center, Mich., USA) under the trade designation Falcon Foam EIFS Compliant Board.

A liquid water pervious adhesive layer is used to adhere the insulation layer to the exteriorly facing surface of the building wall substrate with a water resistive barrier layer between the building wall substrate and the inner facing surface of the insulation layer. The adhesive material has voids that create one or more drainage paths to permit incidental water that has penetrated the exterior finish or wall to drain vertically through the adhesive layer by the force of gravity and exit through intentional weep holes or tracks located at the bottom of the building wall. There is no limitation on the nature of the adhesive material except that is must possess the requisite adhesive performance to adhere and maintain the insulation layer and finish materials on the surface of the building wall substrate and having a sufficient drainability to drain incidental water to weep holes or other exit in the building wall.

According to certain embodiments, the water pervious adhesive material may comprise a non-cementitious polymeric adhesive material. The polymeric component of the non-cementitious water pervious adhesive may comprise, for example, a redispersible polymer material, a dispersion polymer material, or a reactive polymer material. Suitable polymers include, without limitation, acrylic polymers, styrene-acrylic polymers, styrene-butadiene polymers, vinyl acetates, ethylene vinyl acetates, polyurethanes, epoxies, and the like.

According to other illustrative embodiments, the liquid water pervious adhesive material may comprise a polymer-modified cementitious adhesive. The liquid water pervious adhesive layer comprises a polymer modified dry or wet mortar containing a cement material, aggregate, and additives. The polymer component of the adhesive material may include one or more polymers. Without limitation, the aggregate may be selected from sand and lightweight fillers. As used herein, the term cement refers to any hydraulic cement. Hydraulic cements are materials that set and harden in the presence of water. Suitable non-limiting examples of hydraulic cements include Portland cement, masonry cement, alumina cement, refractory cement, calcium aluminate cement, calcium sulfoaluminate cement, ground granulated blast furnace slag, natural cement, and mixtures thereof. Portland cement, as used in the trade, means a hydraulic cement produced by pulverizing clinker, comprising of hydraulic calcium silicates, calcium aluminates, and calcium ferroaluminates, with one or more of the forms of calcium sulfate as an interground addition. Portland cements according to ASTM C150 are classified as types I, II, III, IV, or V.

According to certain illustrative embodiments, the aggregate that is included in the water pervious adhesive has a single or blended particle size distribution that allows the passage of liquid water.

According to additional embodiments, the aggregate that is included in the water pervious adhesive may have a single or a blended particle size distribution that is greater than about 0.2 mm (0.008 in).

According to further illustrative embodiments, the aggregate that is included in the water pervious adhesive may have a single or blended particle size distribution that is from about 0.2 mm (0.008 in) to about 10 mm (0.4 in).

According to further illustrative embodiments, the aggregate that is included in the water pervious adhesive may have a single or blended particle size distribution that is from about 0.2 mm (0.008 in) to about 8 mm (0.3 in).

According to further illustrative embodiments, the aggregate that is included in the water pervious adhesive may have a single or blended particle size distribution that is from about 0.2 mm (0.008 in) to about 5 mm (0.20 in).

The aggregate which may be included in the water pervious adhesive composition may comprise an organic aggregate, an inorganic aggregate, and combinations of organic and inorganic aggregates. The aggregate that may be included in the water pervious adhesive may be one or more organic aggregates, one or more inorganic aggregates, or combinations of one or more organic aggregates with one or more inorganic aggregates. The aggregate included in the water pervious adhesive composition should be able to create one or more drainage paths within the adhesive layer to sufficient to drain water from the exterior finish system and wall. The aggregate should also not compromise the adhesiveness of the polymeric component of the adhesive composition. By way of illustration, and not limitation, the inorganic aggregate may include silica sand, glass microspheres (solid, hollow, or filled), pumice, perlite, and the like. The organic aggregate may comprise, by way of illustration, but not in limitation, polystyrene, polyurethane, polyolefins, such as polypropylene, rubber particles, and the like. According to certain illustrative embodiments, the organic aggregate may comprise polystyrene or polyurethane beads or sphere, such as expanded polystyrene or polyurethane beads.

According to certain illustrative embodiments, the polymeric based water pervious adhesive composition may comprise from about 40 to about 90 weight percent of the polymer component, from about 0.2 to about 45 weight percent of at least one aggregate component, and from 0 to about 15 weight percent of other additives.

Without limitation, the polymeric based water pervious adhesive composition may be prepared from a polyol and an isocyanate. For example, according to certain embodiments, the polymeric based water pervious adhesive is prepared from a polyol prepolymer and methylene diphenyl diisocyante (MDI), which is mixed with an aggregate such as thermoplastic polyurethane or polystyrene beads.

According to certain illustrative embodiments, the polymer-modified cementitious water pervious adhesive composition may comprise from about 32 to about 70 weight percent of at least one cementitious material component, from about 5 to about 30 weight percent of the polymer component, from about 0.3 to about 32 weight percent of at least one aggregate component, from 0 to about 15 weight percent of other additives, and from 0 to about 30 weight percent water.

According to certain illustrative embodiments, the polymer-modified cementitious water pervious adhesive composition may comprise Portland cement, calcium sulfo-aluminate cement, an acrylic polymer dispersion, and thermoplastic polyurethane beads. Further illustrative embodiments of the polymer-modified cementitious water pervious adhesive composition may include Portland cement, an acrylic polymer dispersion, and thermoplastic polyurethane beads.

Other additives that are customarily included in an adhesive composition for exterior finish system may be included in the water pervious adhesive composition. Without limitation, and only by way of illustration, extenders, dispersants, air entrainers, catalysts, fibers, retarders, accelerators, thickeners, defoamers, fillers (inert and/or reactive), rheology modifiers, thixotropic agents, colorants, and the like may be included in the water pervious adhesive composition.

Prior to the application of the exterior finish system, a suitable water resistive barrier may be field or factory applied to the exterior facing surface of the building wall substrate. The water resistive barrier may include conventional water resistive barriers used in building, construction and renovation. According to certain embodiments, the water resistive barriers may include well known and industry accepted sheet materials or factory applied materials that resist the transmission of water therethrough and control the transmission of moisture vapor therethrough. Without limitation, examples of suitable sheet materials include SENERFLASH commercial available from BASF Construction Chemicals LLC—Wall Systems (Jacksonville, Fla., USA). Without limitation, an example of suitable factory applied materials includes the Zip System commercially available from Huber Engineered Woods (Charlotte, N.C., USA).

Without limitation, additional suitable roller, spray, or trowel applied secondary water resistive barriers may include those water barrier materials commercially available from BASF Construction Chemicals—Wall Systems (Jacksonville, Fla.) under the trade designations ENERSHIELD, SENERSHIELD, SENERSHIELD-R, FINESTOP, FINESTOP RA, ACROSTOP R, ACROSTOP T, SONOWALL FT-T, and SONOWALL FTR. SENERSHIELD, FINESTOP, ACROSTOP T and SONOWALL FT-T are 100% acrylic-based, fiber reinforced water resistive barrier materials. SENERSHIELD, FINESTOP, SONOWALL FT-T and ACROSTOP T are trowel-applied continuous membranes that are mixed with Portland cement. SENERSHIELD, FINESTOP, SONOWALL FT-T and ACROSTOP T are suitable for direct application to gypsum sheathing, cement board, poured concrete substrates, unit masonry, and the like. SENERSHIELD-R, FINESTOP RA, ACROSTOP R and SONOWALL FTR are flexible, acrylic liquid coating materials. SENERSHIELD-R, FINESTOP RA, ACROSTOP R and SONOWALL FTR provide a brush-, roller- or spray-applied continuous membrane that is suitable for direct application to a wide variety of approved building wall substrates, such as plywood sheathing, cement board, gypsum sheathing, oriented strand board, poured concrete substrates, masonry unit, and the like.

According to illustrative embodiments, the exterior finishing material comprises exterior insulation and finish system materials. As widely known in the building and construction industry, an exterior insulation and finish system ("EIFS") includes an insulation layer, one or more base coat layers, a reinforcing layer, and one or more finish coat layers. The insulation layer is secured to the water resistive barrier with the water pervious adhesive material and the exterior insulation and finish materials are applied to the opposite surface of the insulation layer. The exterior insulation and finish materials comprise at least base coat that is applied over the insulation layer, a reinforcing mesh layer or layers at least partially embedded in the base coat layer, and at least one finish coat layer that is applied over the base coat and reinforcing mesh layers.

The base coat layers of the exterior insulation and finish system are generally polymer-modified cementitious compositions that adhere to the exterior surface of the insulation layer. The base coat layer can support a reinforcing mesh layer and which, in turn, supports the finish coat layer. Without limitation, suitable base coats for use in the exterior insulation and finish system include base coats commercially available from BASF Construction Chemicals—Wall Systems (Jacksonville, Fla., USA) under the trade designations Alpha Base Coat and Alpha Dry Base Coat. Alpha Base Coat is a water based, 100% acrylic base coat having adhesive properties. Alpha Base Coat is typically field-mixed with Types I or II Portland cement to provide a trowelable base coat. Alpha Dry Base Coat is a dry-mix polymer base coat containing Portland cement. The Alpha Dry Base Coat is field-mixed with water to provide a trowelable base coat. Other suitable EIFS base coats are commercially available BASF Construction Chemicals —Wall Systems under the trade designations SENERGY Standard Base Coat, SENERGY ALPHA GENIE, SENERGY NCII, FINESTONE Adhesive/base coat, FINESTONE A/BC 1-Step, FINESTONE Quick Base, FINESTONE FINEGUARD, FINESTONE FINEBUILD, SONOWALL Adhesive Ground Coat, SONOWALL PrimaCoat, SONOWALL Acrylic Base Coat, ACROCRETE ACRODRY Base Coat, ACROCRETE ACROBASE 90, ACROCRETE ACROBASE 60, ACROCRETE ACROBASE HB, ACROCRETE ACRODRY S Base Coat, ACROCRETE ACROBASE NC, and ACROCRETE ACROTITE Base Coat.

The reinforcing layer, without limitation, may be selected from reinforcing fabrics and meshes. The reinforcing meshes are typically woven or knitted meshes of fibers. The fibers of the reinforcing mesh may include organic or inorganic fibers. The only practical limitations on the type of fibers used to manufacture the reinforcing mesh is that the resulting reinforcing mesh be embeddable in the base coat, that it have sufficient strength to support the finish coat layers of the exterior insulation and finish system, and that it be chemically resistant or inert to the base and finish coats. According to certain embodiments, the reinforcing mesh of the exterior insulation and finish system is a woven fiberglass mesh. A suitable commercially available reinforcing mesh is available from BASF Construction Chemicals—Wall Systems under the trademark SENERGY. The SENERGY reinforcing mesh comprises a balanced, open-weave glass fiber mesh. The reinforcing mesh comprises twisted multi-end strands that are treated for alkali resistance for compatibility with EIFS base coat compositions. Other suitable reinforcing mesh is available from BASF Construction Chemicals—Wall Systems (Jacksonville, Fla., USA) under the trademarks FINESTONE, SONOWALL and ACROCRETE.

Without limitation suitable EIFS finish coats are commercially available from BASF Construction Chemicals—Wall Systems under the following trademarks or trade designations SENERGY SENERFLEX, SENERGY SILCOAT, SENERGY SENERLASTIC, SENERGY SENERLASTIC Plus Finish, SENERGY SENERLASTIC Plus Coating, FINESTONE PEBBELTEX Finishes, FINESTONE FINEMIST, FINESTONE MICAMIST, FINESTONE MICALUX, FINESTONE CORONAMIST, FINESTONE ANTICOGLAZE, FINESTONE AGGRELASTIC, FINESTONE SANDSPRAY, FINESTONE Top Coat, FINESTONE FINELASTIC. SONOWALL ANTICOGLAZE, SONOWALL STUCCOTEX, SONOWALL STUCCOLAST, SONOWALL STUCCOTEX STONE, SONOWALL STUCCOTEX BEAD, SONOWALL STUCCOTEX MICA, SONOWALL METALLIC, SONOWALL STUCCOWALL COAT, SONOWALL STUCCOLAST COAT, SONOWALL STUCCOTEX COAT, ACROCRETE ACROTEXSIL, ACROCRETE ANTICOGLAZE, ACROCRETE ACROTEX Finish, ACROCRETE ACROFLEX II Finish, ACROCRETE ACROFLEXSIL Finish, ACROCRETE ACROCOAT, ACROCRETE ACROCOTE T, ACROCRETE ACROTESIL, ACROCRETE ACROTESIL T, ACROCRETE ACROLASTIC Coating, ACROCRETE ACROLASTICSIL Coating, and METALLIC ACROCRETE.

While liquid-applied (ie, brush-, roller-, spray-, trowel-applied) water resistive coating membranes are widely used with adhesively applied EIFS, the water resistive barrier may alternatively comprise well known and industry accepted building papers or tar papers that resist the transmission of water therethrough and control the transmission of moisture vapor therethrough. Without limitation, an example of a suitable weather barrier which is well known in the art is Jumbo Tex® Vapor Permeable Weather Resistive Barrier manufactured by Fortifiber® Corporation of Incline Village, Nev., although other similar building papers are well known and used in the relevant art.

According to other certain embodiments, the water resistive barrier may comprise a polymeric sheet material. The water resistive barrier may be comprised of a non-woven sheet of polymeric fibers, such as polyolefin fibers. Without limitation, the polyolefin fibers that are useful in the preparation of the water resistive barrier may be selected from polypropylene fibers and high density polyethylene fibers. A useful water resistive barrier comprises a non-woven sheet of spun-bonded high density polyethylene fibers. Non-woven sheets of spun-bonded high density polyethylene fibers are commercially available from E.I. DuPont de Nemours & Co., Inc. (Wilmington, Del.) under the trademarks Tyvek® HomeWrap™, Tyvek® StuccoWrap™ and Tyvek® CommercialWrap™. The non-woven structure provides excellent resistance to water and air penetration. In addition, the non-woven structure has excellent strength and tear resistance.

Also provided is a method of finishing a building wall. The method includes disposing the water pervious adhesive material between the water resistive barrier and the inner facing surface of the insulation layer. The water pervious adhesive material may be positioned between the water resistive barrier layer and the insulation layer by applying a liquid water pervious adhesive layer to the surface of either or both of the water resisitive barrier coated building wall substrate and the insulation layer. The water pervious adhesive may be applied to the barrier coated building wall substrate and/or the insulation layer as a continous coating. Alternatively, the water pervious adhesive may be applied to the barrier coated building wall substrate and/or the insulation layer in one or more distinct patterns. The insulation layer is brought into contact with the exteriorly facing surface of the barrier coated building wall to adhere the insulation layer to the water resisitive barrier coated building wall substrate. When the insulation layer is placed adjacent to the water resistive barrier, the water pervious adhesive is disposed between coated building wall substate and the insulation layer. A decorative and protective finish layer is applied to the exteriorly facing surface of said insulation layer.

Illustrative embodiments of the exterior insulation and finish system and building wall will now be described in greater detail in conjunction with illustrative FIG. 1. It should be noted that the exterior insulation and finish system and building wall are not intended to be limited to the illustrative embodiment shown in FIG. 1.

Referring now to FIG. 1, a building wall 10 incorporating the exterior insulation and finish system 20 is shown. As shown in FIG. 1, building wall 10 may be a typical 2×4 frame construction, although other construction techniques and configurations are equally suitable environments for exterior insulation and finish system 20. Building wall 10 is generally constructed of a frame 30, a substrate such as a sheathing material 36 and the exterior insulation and finish system 20. Frame 30 typically includes a plurality of studs 32, which are members of wood or steel having nominal dimensions of 2"×4". Studs 32 are vertically oriented and are parallel and spaced apart a distance of typically 16" or 24", although these dimensions are merely illustrative. Studs 32 are each typically fixedly attached at an upper end to a plate 34, with plate 34 typically being a member of similar dimension to studs 32 and oriented horizontally such that multiple vertical studs 32 in a wall 10 are fixedly attached to a single plate 34. Studs 32 are usually fixedly attached to plate 34 by means of mechanical fasteners such as nails and/or screws (not shown). Moreover, studs 32 are each typically attached to a lower sill plate (not shown) which is of a similar configuration to plate 34.

Exterior insulation and finish system 20 includes rigid expanded polystyrene insulation board 22. Base coat 24 is applied to the exteriorly facing surfaces of insulation board 22. A reinforcing mesh 26 of woven fiberglass is embedded within the EIFS base coat 22. An EIFS finish coat 28 is then applied over the previously applied components to create an aesthetic and protective finish. A liquid water-pervious adhesive layer 40 is disposed between the water resistive barrier 50 coated substrate sheathing 36 and the insulation layer 22.

EXAMPLES

The following examples are set forth to describe certain illustrative embodiments of the water pervious adhesive in further detail and to illustrate the use of the water pervious adhesive in an exterior finish system and building wall. The examples should not be construed as limiting the present invention in any manner.

Various examples of the water pervious adhesive for exterior finish systems were evaluated for water drainage capability and adhesion to building wall substrates after exposure to water. The test methods for evaluating water drainage capability and adhesion are set forth below.

Drainage Properties

To determine the drainage properties of the water pervious adhesive, a test panel is fabricated by applying an approximately ¼ inch solid layer of the adhesive to one surface of an expanded polystyrene (EPS) insulation board and then adhering it to the face the coated wall substrate. At 1 day after the EPS board was adhered to the wall substrate, the initial weight of the cured panel is taken. 504 grams of water is introduced through the top of the panel over a period of 60 minutes and collected in a tray positioned below the test panel. At the end of 60 minutes the test panel is allowed to drain for 5 minutes then the bottom and top of the panel is blotted dry and a final weight taken to calculate the percent drainage. If the drainage value is 90% or greater, then the adhesive is considered to be pervious.

Adhesion Properties

To determine the early adhesion properties of the adhesive, the EPS board is manually detached from the substrate following the drainage test and examined. If the majority of the EPS board remains bonded to the coated substrate, then the adhesion is deemed acceptable. In the case of the cement based adhesive which take longer to develop strength, if the adhesion is comparable to the cement based control sample of Alpha Basecoat adhesive (commercially available from BASF Construction Chemicals), then it is deemed acceptable.

Example 1

100 grams of a prepolymer consisting of polyol and MDI is mixed with 35 grams of approximately 4 mm (0.16 in)sized thermoplastic polyurethane beads to produce a water pervious adhesive composition. The water pervious adhesive composition is allowed to cure for 1 day. After 1 day of curing, drainage testing is performed on the adhesive composition. According to this example, the water flowed through the adhesive composition resulting in 96% drainage and the adhesive remained bonded to the coated substrate.

Example 2

100 grams of a prepolymer consisting of polyol and MDI is mixed with 50 grams of approximately 4 mm (0.16 in) sized thermoplastic polyurethane beads to produce the pervious adhesive composition. The water pervious adhesive composition is allowed to cure for 1 day. After 1 day of curing, drainage is testing performed on the adhesive composition. According to this example, the water flowed through the adhesive resulting in 98% drainage and the adhesive remained bonded to the coated substrate.

Example 3

100 grams of a prepolymer consisting of polyol and MDI is mixed with 10 grams of approximately 4 mm (0.16 in) sized thermoplastic polyurethane beads to produce the pervious adhesive composition. The adhesive composition is allowed to cure for 1 day, followed by drainage testing as described above. In this example, the water flowed through the adhesive resulting in 98% drainage and the adhesive remained bonded to the coated substrate.

Example 4

100 grams of a prepolymer consisting of polyol and MDI is mixed with 1 gram of approximately 4-5 mm (0.16-0.20 in) sized expanded polystyrene beads to produce the pervious adhesive composition. The adhesive composition is allowed to cure for 1 day, followed by the above-described drainage testing. In this example, the water flowed through the adhesive resulting in 98% drainage and the adhesive remained bonded to the coated substrate.

Example 5

100 grams of a prepolymer consisting of polyol and MDI is mixed with 7 grams of approximately 4-5 mm (0.16-0.20 in) sized expanded polystyrene beads to produce the pervious adhesive composition. The adhesive composition is allowed to cure for 1 day, followed by drainage testing as described above. In this example, the water flowed through the adhesive resulting in 97% drainage and the adhesive remained bonded to the coated substrate.

Example 6

250 grams of a polyurethane adhesive is blended with 1 gram of approximately 4-5 mm (0.16-0.20 in) sized expanded polystyrene beads to produce the pervious adhesive composition. The adhesive composition is allowed to cure for 1 day, followed by drainage testing as described above. In this example, the water flowed through the adhesive resulting in 98% drainage and the adhesive remained bonded to the coated substrate.

Example 7

189 grams of a Portland cement, 33 grams of calcium sulfo-aluminate (CSA) cement, 53 grams of an acrylic polymer dispersion, 53 grams of water are blended together with 80 grams of approximately 4 mm (0.16 in) sized thermoplastic polyurethane beads to produce the pervious adhesive composition. The adhesive composition is allowed to cure for 1 day, followed by drainage testing as described. In this example, the water flowed through the adhesive resulting in 95% drainage and the adhesion was comparable to the Alpha Basecoat.

Example 8

222 grams of Portland cement, 53 grams of an acrylic polymer dispersion, 53 grams of water are blended together with 80 grams of approximately 4 mm (0.16 in) sized thermoplastic polyurethane beads to produce the pervious adhesive composition. The adhesive composition is allowed to cure for 1 day, followed by drainage testing as described above. In this example, the water flowed through the adhesive resulting in 96% drainage and the adhesion was comparable to the Alpha Basecoat.

While the exterior insulation and finish system and building wall have been described above in connection with the certain embodiments, it is to be understood that other embodiments may be used or modifications and additions may be made to the described embodiments for performing the same function without deviating therefrom. Further, all embodiments disclosed are not necessarily in the alternative, as various embodiments may be combined to provide the desired characteristics. Variations can be made by one having ordinary skill in the art without departing from the spirit and scope of the exterior finishing system and building wall. Therefore, the disclosure should not be limited to any single embodiment, but rather construed in breadth and scope in accordance with the recitation of the attached claims.

We claim:

1. A building wall comprising:

a building wall substrate;

a water resistive barrier layer applied to a portion of said building wall substrate;

an insulation layer having opposite interiorly and exteriorly facing surfaces;

a water pervious adhesive layer disposed between said water resistive barrier layer and said insulation layer adhering said insulation layer to said building wall substrate, said water pervious adhesive layer comprising a water pervious adhesive comprising internal voids that create one or more drainage paths within said water pervious adhesive layer, wherein said water pervious adhesive comprises a polymeric adhesive comprising from about 40 to about 90 weight percent of a polymer component, and from about 0.2 to about 45 weight percent of at least one aggregate component; and an exterior finish material applied to at least a portion of the exteriorly facing surface of said insulation layer.

2. The building wall of claim 1, wherein said polymeric adhesive comprises a polymer binder and polymeric aggregate.

3. The building wall of claim 1, wherein said water pervious adhesive layer further comprises from 0 to about 15 weight percent of one or more additives seleted from the group consisting of extenders, dispersants, air entrainers, catalysts, fibers, retarders, accelerators, thickeners, defoamers, inter fillers, reactive fillers, rheology modifiers, thixotropic agents and colorants.

4. The building wall of claim 1, wherein said water resistive barrier layer comprises a liquid-applied coating, wherein said liquid-applied coating is selected from the group consisting of a polymeric coating, a polymer-containing cementitious coating, and a fiber-reinforced polymeric coating.

5. The building wall of claim 1, wherein said building wall substrate is selected from the group consisting of a wood frame, metal frame, plywood sheathing, cement board, gypsum board, oriented strand board, wafer board, fiberboard, poured concrete wall, and concrete masonry units.

6. The building wall of claim 1, wherein said insulation layer comprises a substantially rigid expanded polystyrene board.

7. The building wall of claim 1, wherein said exterior finish material comprises an exterior insulation and finish system comprising at least one base coat layer, a reinforcing layer, and at least one finish coat layer.

8. The building wall of claim 7, wherein said base coat is selected from cementitious base coats, polymer base coats, and polymer-modified cementitious base coats.

9. The building wall of claim 8, wherein said reinforcing layer is selected from the group consisting of reinforcing fabrics and meshes.

10. The building wall of claim 8, wherein said finish coat is selected from the group consisting of cementitious finish coats, polymer based finish coats, and polymer-modified cementitious finish coats.

11. An exterior finish system for building walls comprising:

an insulation layer having first and second opposite facing surfaces;

a water pervious adhesive layer adjacent said first opposite facing surface of said insulation layer, said water pervious adhesive layer comprising a water pervious adhesive comprising internal voids that create one or more drainage paths within said water pervious adhesive layer, wherein said water pervious adhesive layer comprises a polymeric adhesive comprising from about 40 to about 90 weight percent of a polymer component, and from about 0.2 to about 45 weight percent of at least one aggregate component;

a water resistive layer adjacent the water pervious adhesive layer, and an exterior finish material applied to said second opposite facing surface of said insulation layer.

12. The exterior finish system of claim 11, wherein said polymeric adhesive comprises a polymeric binder and a polymeric aggregate.

13. The exterior finish system of claim 11, wherein said water pervious adhesive layer further comprises from 0 to about 15 weight percent of one or more additives seleted from the group consisting of extenders, dispersants, air entrainers, catalysts, fibers, retarders, accelerators, thickeners, defoamers, inter fillers, reactive fillers, rheology modifiers, thixotropic agents and colorants.

14. The exterior finish system of claim 11, wherein said insulation layer comprises a substantially rigid expanded polystyrene board.

15. The exterior finish system of claim 11, wherein said water resistive layer comprises a liquid-applied coating.

16. The exterior finish system of claim 15, wherein said liquid-applied coating is selected from the group consisting of a polymeric coating, a polymer-containing cementitious coating, and a fiber-reinforced polymeric coating.

17. The exterior finish system of claim 11, wherein said exterior finish material comprises an exterior insulation and finish system comprising at least one base coat layer, a reinforcing layer, and at least one finish coat layer.

18. The exterior finish system of claim 17, wherein said base coat is selected from cementitious base coats, polymer base coats, and polymer-modified cementitious base coats.

19. The exterior finish system of claim 18, wherein said reinforcing layer is selected from the group consisting of reinforcing fabrics and meshes.

20. The exterior finish system of claim 18, wherein said finish coat is selected from the group consisting of cementitious finish coats, polymer based finish coats, and polymer-modified cementitious finish coats.

* * * * *